US007942992B2

(12) United States Patent
Saka et al.

(10) Patent No.: US 7,942,992 B2
(45) Date of Patent: May 17, 2011

(54) BULKY SHEET MATERIAL HAVING THREE-DIMENSIONAL PROTRUSIONS

(75) Inventors: Wataru Saka, Tochigi (JP); Shoichi Taneichi, Tochigi (JP); Takanobu Miyamoto, Tochigi (JP)

(73) Assignee: Kao Corporation, Tokyo (JP)

( * ) Notice: Subject to any disclaimer, the term of this patent is extended or adjusted under 35 U.S.C. 154(b) by 39 days.

(21) Appl. No.: 12/472,095

(22) Filed: May 26, 2009

(65) Prior Publication Data

US 2009/0294019 A1 Dec. 3, 2009

Related U.S. Application Data

(62) Division of application No. 10/372,205, filed on Feb. 25, 2003, now abandoned.

(30) Foreign Application Priority Data

Feb. 25, 2002 (JP) ..... 2002-047353

(51) Int. Cl.
*B29C 61/02* (2006.01)
*B29C 65/18* (2006.01)
*D04H 1/54* (2006.01)

(52) U.S. Cl. ..... 156/85; 156/290

(58) Field of Classification Search ..... 156/85, 156/290, 308.4, 309.6
See application file for complete search history.

(56) References Cited

U.S. PATENT DOCUMENTS

| | | | | |
|---|---|---|---|---|
| 5,198,057 | A | 3/1993 | Newkirk et al. | |
| 5,382,400 | A | 1/1995 | Pike et al. | |
| 5,491,016 | A | 2/1996 | Kaiser et al. | |
| 7,201,816 | B2 * | 4/2007 | Zafiroglu et al. | 156/84 |
| 2003/0000934 | A1 * | 1/2003 | Tanaka et al. | 219/244 |
| 2003/0082360 | A1 * | 5/2003 | O'Donnell et al. | 428/292.1 |
| 2003/0134094 | A1 | 7/2003 | Zafiroglu et al. | |

FOREIGN PATENT DOCUMENTS

| | | | |
|---|---|---|---|
| EP | 181300 | A2 | 5/1986 |
| EP | 0 586 924 | A1 | 3/1994 |
| JP | 51-146584 | A | 12/1976 |
| JP | 61-124667 | A | 6/1986 |
| JP | 63-296936 | A | 12/1988 |
| JP | 63-309657 | A | 12/1988 |

(Continued)

OTHER PUBLICATIONS

Chinese Office Action issued Jan. 19, 2007 in corresponding Chinese Application No. 03103785.2.

*Primary Examiner* — Michael A Tolin
(74) *Attorney, Agent, or Firm* — Birch, Stewart, Kolasch & Birch, LLP

(57) ABSTRACT

A bulky sheet material having three-dimensional protrusions comprises a first fiber layer and a second fiber layer provided on at least one side of the first fiber layer. The first fiber layer contains thermally shrunken heat-shrinkable fibers. The second fiber layer comprises heat non-shrinkable fibers. The first fiber layer and the second fiber layer are partly joined together at a large number of joints formed by fusion bonding. The joints are formed by melting and solidification of a heat fusible resin having a higher melting point than the shrinkage starting temperature of the heat shrinkable fiber. The second fiber layer forms a large number of protrusions between the joints by the heat shrinkage of the first fiber layer while leaving the joints as depressions.

5 Claims, 2 Drawing Sheets

FOREIGN PATENT DOCUMENTS

| | | | |
|---|---|---|---|
| JP | 2-133641 | A | 5/1990 |
| JP | 2-300365 | A | 12/1990 |
| JP | 3131557 | A | 6/1991 |
| JP | 4 222264 | A | 8/1992 |
| JP | 4-312431 | A | 11/1992 |
| JP | 5-25763 | A | 2/1993 |
| JP | 7-232409 | A | 9/1995 |
| JP | 8-3850 | A | 1/1996 |
| JP | 9-3755 | A | 1/1997 |
| JP | 9-117982 | A | 5/1997 |
| JP | 9-158022 | A | 6/1997 |
| JP | 2000-136477 | A | 5/2000 |
| JP | 2001-140158 | A | 5/2001 |
| WO | WO 01/53586 | A1 * | 7/2001 |

* cited by examiner

BULKY SHEET MATERIAL HAVING THREE-DIMENSIONAL PROTRUSIONS

This application is a Divisional of application Ser. No. 10/372,205 filed on Feb. 25, 2003, now abandoned, and for which priority is claimed under 35 U.S.C. §120; and this application claims priority of Application No. 2002-47353 filed in Japan on Feb. 25, 2002 under 35 U.S.C. §119; the entire contents of all are hereby incorporated by reference.

BACKGROUND OF THE INVENTION

The present invention relates to a bulky sheet material comprising nonwoven fabric having a large number of protrusions.

Japanese Patent 3,131,557 discloses wrinkled nonwoven fabric composed of a first fiber layer comprising heat shrinkable fiber and heat bondable fiber whose melting point is lower than the shrinkage starting temperature of the heat shrinkable fiber and a second fiber layer comprising heat non-shrinkable fiber superposed on one side of the first fiber layer, the first and second fiber layers being joined by thermal fusion bonding in a stripe pattern. The fusion bonded joints are depressions, and the second fiber layer forms a great number of streaky wrinkles (ridges) between the fusion bonded joints. The wrinkled nonwoven fabric is produced by superposing the first fiber layer and the second fiber layer, joining the two layers by fusion bonding at a temperature lower than the shrinkage starting temperature of the heat shrinkable fiber, and blowing hot air at or above the shrinkage starting temperature to shrink the shrinkable fiber. Because shrinking the heat shrinkable fiber is effected at temperatures higher than the melting point of the resin making the heat bondable fiber, it is accompanied by fusion of the heat bondable fiber, which results in stiffness of the resulting nonwoven fabric. Further, the bonding strength between the two layers is limited because the thermal fusion bonding of the first and second fiber layers relies on the heat bondable fiber which is contained in the first fiber layer in a proportion of 30 to 50% by weight. With the limited bonding strength, the fusion bonded joints are apt to loosen when the first fiber layer shrinks or while the resulting nonwoven fabric is further processed or in use, which results in an obscure pattern of ridges or a failure to form a desired pattern of ridges.

JP-A-9-3755 discloses nonwoven fabric with a textured surface which is composed of a first fiber layer containing thermally shrunken fiber and a second fiber layer containing non-shrinkable short fiber superposed on one side of the first fiber layer, the first and second fiber layers being joined by partial heat fusion bonding. The second fiber layer has raised portions making regular protrusions between the fusion bonded joints by heat shrinkage of the first fiber layer. The nonwoven fabric is produced by superposing the first and second fiber layers and passing the two layers under an embossing roll thereby joining them together in parts and simultaneously causing the first fiber layer to shrink. Because heat is hardly conducted throughout the first fiber layer from the embossed parts, it is difficult to shrink the heat shrinkable fiber of the first fiber layer to a high shrinkage percentage for sufficiently making the second fiber layer protrude. Where the fibers constituting the second fiber layer are in an unbonded state, the network of the fusion bonded fibers is insufficient for forming protrusions having high shape retention. As a result, the protrusions are collapsed easily and fuzz up easily.

SUMMARY OF THE INVENTION

An object of the present invention is to provide a bulky sheet material having a good texture, a satisfactory appearance, and high shape retention for its protrusions. Another object of the present invention is to provide a process of easily producing a bulky sheet material having protrusions of desired shape.

The objects of the present invention are accomplished by a bulky sheet material having three-dimensional protrusions comprising a first fiber layer and a second fiber layer provided on at least one side of said first fiber layer, said first fiber layer containing thermally shrunken heat-shrinkable fibers, said second fiber layer comprising heat non-shrinkable fibers, said first fiber layer and said second fiber layer being partly joined together at a large number of joints formed by fusion bonding, said joints being formed by melting and solidification of a heat fusible resin having a higher melting point than the shrinkage starting temperature of said heat shrinkable fiber, said second fiber layer forming a large number of protrusions between said joints by the heat shrinkage of the first fiber layer, and said joints forming depressions.

The present invention also provides a preferred process of producing the bulky sheet which comprises:

partly fusion bonding a first fiber layer-forming material containing said heat shrinkable fibers and a second fiber layer-forming material comprising said heat non-shrinkable fibers provided on at least one side of said fiber layer-forming material with a heat embossing machine at or above the shrinkage starting temperature of said heat shrinkable fiber of said first fiber layer-forming material while applying tension to both said first fiber layer-forming material and said second fiber layer-forming material to form said joints, continuing applying said tension to both said first fiber layer-forming material and said second fiber layer-forming material which have passed through the heat embossing machine until the temperature of said heat shrinkable fibers contained in said first fiber layer-forming material reduces lower than the shrinkage starting temperature of said heat shrinkable fiber, releasing said tension and heating said first fiber layer-forming material and said second fiber layer-forming material at or above the shrinkage starting temperature of said heat shrinkable fiber to shrink said heat shrinkable fibers and to raise said second fiber layer-forming material between said joints thereby to form a large number of said protrusions.

The present invention also provides a bulky sheet material having three-dimensional protrusions comprising a first fiber layer and a second fiber layer provided on at least one side of said first fiber layer, said first fiber layer containing thermally shrunken heat-shrinkable fibers, said second fiber layer comprising heat non-shrinkable fibers, said bulky sheet material being obtainable by:

superposing a second fiber layer-forming material comprising said heat non-shrinkable fibers on at least one side of a first fiber layer-forming material containing said heat-shrinkable fibers, partly fusion bonding said first fiber layer-forming material and said second fiber layer-forming material with a heat embossing machine while applying tension to both said first fiber layer-forming material and said second fiber layer-forming material to form a large number of fusion bonded joints, said joints being formed by melting and solidification of a heat fusible resin having a higher melting point than the shrinkage starting temperature of said heat shrinkable fiber, and thermally shrinking said heat shrinkable fibers of said first fiber layer-forming material to form a large number of protrusions and depressions.

The present invention also provides a heat-shrinkable heat-embossed nonwoven fabric comprising a first fiber layer and a second fiber layer provided on at least one side of said first fiber layer, said first fiber layer containing heat shrinkable fibers in a shrinkable state, said second fiber layer comprising heat non-shrinkable fibers, said first fiber layer and said second fiber layer being partly joined together at a large number of joints formed by fusion bonding, said joints being formed by melting and solidification of a heat fusible resin having a higher melting point than the shrinkage starting temperature of said heat shrinkable fiber.

BRIEF DESCRIPTION OF THE DRAWINGS

The present invention will be more particularly described with reference to the accompanying drawings, in which.

DETAILED DESCRIPTION OF THE PREFERRED EMBODIMENTS

Figure 1:
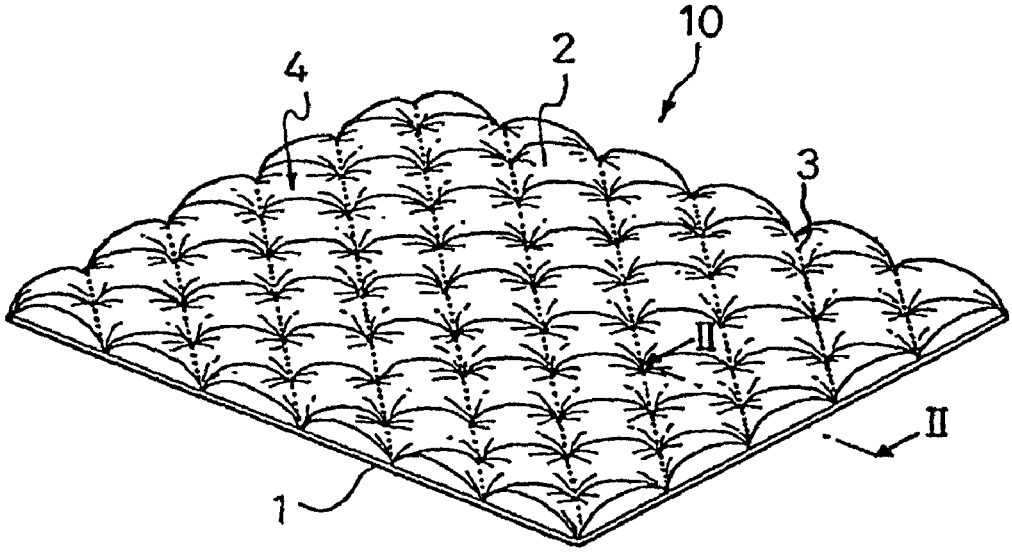
FIG. 1 is a perspective of an embodiment of the bulky sheet material according to the present invention.
Figure 2:
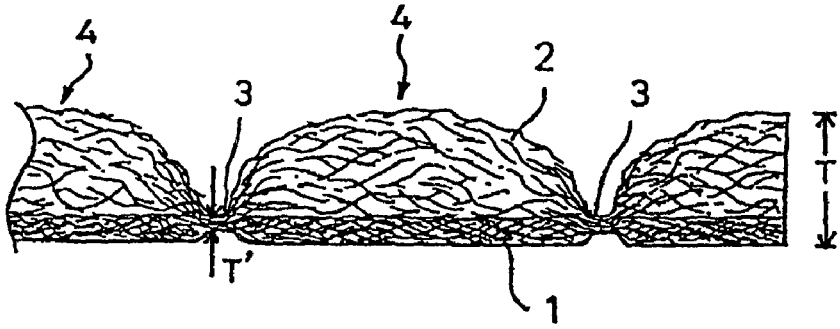
FIG. 2 is a cross section of the bulky sheet material of FIG. 1, taken along line II-II.

The present invention will be described in greater detail chiefly based on its preferred embodiments with reference to the accompanying drawings. An embodiment of the bulky sheet material according to the present invention is shown in FIG. 1. FIG. 2 presents a cross-section of the bulky sheet material shown in FIG. 1, taken along line II-II.

The bulky sheet material 10 shown in FIG. 1 comprises a nonwoven fabric having a first fiber layer 1 and a second fiber layer 2 adjoining each other. The first fiber layer 1 is made of a first fiber layer-forming material which is a fiber aggregate. The second fiber layer 2 is made of a second fiber layer-forming material which is an aggregate of fiber different from the fiber making up the first fiber layer 1 in kind and/or composition. The first fiber layer 1 and the second fiber layer 2 are partly joined together at a large number of joints 3. In this embodiment, the joints 3, when seen from above, each have a circular shape and are discretely arranged to make a lattice pattern as a whole. To have the joints arranged discretely is preferred for not hindering shrinkage of the heat shrinkable fibers of the first fiber layer-forming material. The bulky sheet material 10 is densified at the joints 3 to have a smaller thickness and a larger density than at other portions.

The joints 3 are heat fusion bonded parts formed by heat embossing the first fiber layer-forming material and the second fiber layer-forming material. With the fusion bonded parts, the two fiber layers are united in their thickness direction. The fusion bonded parts are formed by melting and solidification of a heat bondable fiber having a higher melting point than the shrinkage starting temperature $T_S$ of heat shrinkable fiber (described later) contained in the first fiber layer-forming material. The term "melting point" as used herein means the maximum peak temperature in a DSC (differential scanning calorimetry) curve prepared in measurement of heat of fusion of a polymer with a DSC. As described infra, the heat fusible resin is present in at least one of the first fiber layer and the second fiber layer preferably in the form of heat bondable fiber containing the same. Where the heat bondable fiber is a multi-component conjugate fiber, the lowest of the melting points of the constituent resins is taken as the "melting point" of the fiber. The fusion bonded parts may be formed by melting and solidification of the heat shrinkable fiber. The individual joints 3 may have an arbitrary shape, such as a circular shape as adapted in this particular embodiment, an elliptic shape, a triangular shape, a rectangular shape or a combination thereof. The joints 3 may be continuously formed to make a line pattern, such as a pattern of straight lines or curved lines.

The ratio of the total area of the joints 3 to the area of the bulky sheet material 10 (the area of the joints 3 per unit area of the bulky sheet material 10) is, while dependent on a particular use of the bulky sheet material 10, preferably 3 to 50%, still preferably 5 to 35%, as measured after joints 3 formation and before shrinkage of the first fiber layer-forming material and preferably 6 to 90%, still preferably 10 to 70%, as measured after shrinkage of the first fiber layer-forming material. These joint area ratio ranges are preferred for assuring bonding between the two fiber layers 1 and 2 while allowing the second fiber layer-forming material to rise to form protrusions with sufficient height for bulkiness.

The second fiber layer has a great number of protrusions 4 raised between the joints 3 by the heat shrinkage of the first fiber layer-forming material. That is, in the present embodiment, the bulky sheet material 10 has a large number of closed portions each surrounded by the joints 3 arranged in a diamond pattern, and the second fiber layer 2 in each of these closed portions is raised to form a protrusion 4 as shown in FIG. 2. The individual protrusions 4 in the present embodiment are dome-shaped and filled with the fiber constituting the second fiber layer 2. The joints 3 form depressions relative to the protrusions 4. The first fiber layer 1 is almost flat between every adjacent joints 3 (see FIG. 2). As a whole, the bulky sheet material 10 is structured to have flatness on the first fiber layer 1 side and a great number of protrusions and depressions on the second fiber layer 2 side.

Whatever shape the protrusions 4 of the second fiber layer 2 may have, the bulky sheet material 10 feels sufficiently bulky as long as the ratio of thickness T at the apex of the protrusion 4 to thickness T' at the joint 3, i.e., T/T' (see FIG. 2) is 20 or greater, particularly 30 or greater. The upper limit of T/T' is decided according to the shape retention of the protrusions 4 and the basis weight of the bulky sheet material 10. A practical upper limit of T/T' is about 80, particularly about 50.

The thicknesses T and T' are measured as follows. The bulky sheet material 10 is cut into a 50 cm side square piece. A plate weighing 10 g and larger than the cut piece is put on the cut piece, and the thickness of the piece in this state, which is taken as thickness T of the protrusions, is measured with, for example, a dial gauge or a laser displacement meter. The thickness T thus measured equals to a "thickness (of the bulky sheet material) under a pressure of 0.4 cN/cm$^2$" as hereinafter referred to.

On the other hand, the thickness T' is measured while a pressure of 10 to 40 N/cm$^2$ is applied to the joint 3 with a feeler equal to or smaller than the joint 3 in size. Measurement can be made with the same instrument as used for the measurement of thickness T.

The bulky sheet material 10 has a low-density structure to show sufficient compressive deformability when compressed in the thickness direction. More specifically, it is generally preferred, while depending on the final use, for the bulky sheet material 10 to have an apparent density of 5 to 50 kg/m$^3$, particularly 10 to 30 kg/m$^3$, under a pressure of 0.4 cN/cm$^2$. The bulky sheet material 10 having such an apparent density feels bulky and exhibits improved compressive deformability, which leads to improved flexibility. It is also preferred for the bulky sheet material 10 to have an apparent density of 20 to 130 kg/m$^3$, particularly 30 to 120 kg/m$^3$, under a pressure of 34.2 cN/cm$^2$. The bulky sheet material 10 having such an apparent density has sufficient strength to exhibit improved three-dimensional shape retention while securing sufficient breathability. To secure sufficient breathability is especially effective to prevent an overhydration-induced skin rash when the bulky sheet material 10 is used as a member of an absorbent article, for example. The pressure of 0.4 cN/cm$^2$ is almost equal to the pressure applied to an absorbent article while fitted to a wearer's body, and the pressure of 34.2 cN/cm$^2$ is almost equal to the body pressure imposed to an absorbent article while worn.

The apparent density of the bulky sheet material 10 under a pressure of 0.4 cN/cm$^2$ and that under a pressure of 34.2 cN/cm$^2$ are obtained by dividing the basis weight by the thickness under the respective pressure hereinafter described.

While varying according to the use, the thickness of the bulky sheet material 10 is preferably 1.5 to 10 mm, particularly 2 to 6 mm, under a pressure of 0.4 cN/cm$^2$ and 1 to 5 mm, particularly 1.5 to 3 mm, under a pressure of 34.2 cN/cm$^2$ from the standpoint of bulkiness and compressive deformability.

The thickness under a pressure of 0.4 cN/cm$^2$ (hereinafter referred to as T1) is measured as follows. The bulky sheet material 10 is cut into a 50 mm side square specimen. A plate weighing 10 g and larger than the specimen in size is placed on the stage of a measuring instrument. The height of the upper surface of the plate in this state is taken as a reference point A. The plate is removed, and the specimen is placed on the stage. The plate is again put on the specimen. The height of the upper surface of the plate in this state is taken as a point B. The difference between A and B is the thickness T1 of the bulky sheet material 10. Measurement is made with a laser displacement meter (CCD Laser Displacement Sensor LK-080, supplied by Keyence Corp.). Thickness T1 may also be measured with a dial gauge, in which case the measuring pressure of the instrument and the weight of the plate are adjusted to give a pressure of 0.4 cN/cm$^2$.

The thickness under a pressure of 34.2 cN/cm$^2$ (hereinafter referred to as T2) is measured as follows. Measurement is made with a tensile-compression tester RTM-100, supplied by Toyo Baldwin Co., Ltd., which is capable of deforming a specimen by compressing at a constant speed. A 50 mm side square specimen cut out of the material 10 is set on the tester, and a compression plate fitted to a load cell (rating: 5 kg) is moved downward at a rate of 10 mm/min to compress the specimen. T2 is obtained from the load imposed to the load cell and the displacement by compression. Specifically, the position of the compression plate giving a reading of 2 gf (0.1% of the full scale, 2 kg) is taken as an original point, and a displacement X1 under a pressure of 0.4 cN/cm$^2$ and a displacement X2 under a pressure of 34.2 cN/cm$^2$ are read. T2 is calculated from X1, X2, and T1 (all given in negative values with respect to the original point) according to equation (1):

$$T2=T1+(X2-X1) \quad (1)$$

It is preferred that the bulky sheet material 10 have a compressive deformation percentage of 30 to 85%, particularly 40 to 70%, the compressive deformation percentage being calculated from T1 and T2 by equation (2):

$$\text{Compressive deformation (\%)}=(T1-T2)/T1\times 100 \quad (2)$$

In order for the bulky sheet material 10 to have sufficient compressive deformability and bulkiness, it is preferred for the bulky sheet material 10 to have a basis weight of 20 to 200 g/m$^2$, particularly 40 to 150 g/m$^2$. The basis weight is obtained by weighing a cut piece of the bulky sheet material 10 having a size of at least 50 mm by 50 mm by means of an electronic balance whose figure of merit is 1 mg and calculating the weight per m$^2$.

The first fiber layer-forming material contains heat shrinkable fibers. In the bulky sheet material 10, the heat shrinkable fiber is present in its shrunken state. The heat shrinkable fiber is not particularly limited, and any known heat shrinkable fibers can be used. It is particularly favorable to use self-crimping fiber as the heat shrinkable fiber. Use of self-crimping fiber imparts the first fiber layer 1 with elastomeric properties, which make the bulky sheet material 10 exhibit elastomeric behavior as a whole. The bulky sheet material 10 which exhibits elastomeric behavior will show satisfactory deformability in conformity to a wearer's movement when used as a member of an absorbent article. An absorbent article having such a bulky sheet material will have an improved fit to a wearer and effectively prevent leakage. Self-crimping fibers include conjugate fibers consisting of two thermoplastic polymers having different shrinkage characteristics in an eccentric core-sheath configuration or a side-by-side configuration. Examples of such self-crimping conjugate fibers are given in JP-A-9-296325 and Japanese Patent 2759331. A combination of an ethylene-propylene random copolymer and polypropylene is an example of suitable thermoplastic polymers having different shrinkage percentages. The heat shrinkable fiber may be staple fiber (short fiber) or filaments (long fiber). The fineness of the heat shrinkable fiber is suitably about 1 to 7 dtex. The shrinkage starting temperature $T_S$ of the heat shrinkable fiber can be selected from a range, e.g., of from 90 to 110° C. The term "shrinkage starting temperature" as used herein denotes a measured temperature of an oven capable of elevating temperature at a constant rate of temperature rise at which a fiber put in the oven substantially starts shrinking. In Examples hereinafter given, heat shrinkable fibers having a $T_S$ of about 90° C. were used. The first fiber layer 1 (or the first fiber layer-forming material) can be made solely of the heat shrinkable fiber or contain other fibers as mentioned below. In the latter case, it is preferred for the first fiber layer 1 to contain the heat shrinkable fiber in a proportion of at least 50% by weight, particularly from 70 to 90% by weight.

The other fibers the first fiber layer 1 can contain include heat bondable fibers. With heat bondable fiber incorporated into the first fiber layer 1, the individual fibers constituting the first fiber layer 1 show good fusibility among themselves, and the first fiber layer 1 and the second fiber layer 2 exhibit good fusibility to each other. The heat bondable fiber to be incorporated preferably contains a heat fusible resin whose melting point $T_M$ is higher than the shrinkage starting temperature $T_S$ of the heat shrinkable fiber. Existence of such a heat fusible resin improves fusibility to a heat fusible resin (described later) if present in the second fiber layer-forming material and the texture after shrinkage. In order to obtain improved fusibility to the second fiber layer-forming material while assuring shrinkability of the heat shrinkable fiber, the proportion of the heat bondable fiber in the first fiber layer-forming material is preferably up to 50% by weight, still preferably 10 to 30% by weight, based on the weight of the first fiber layer 1.

The form of the first fiber layer-forming material providing the first fiber layer 1 on shrinking includes a web, which means a fiber aggregate in which the constituent fibers are in a state not bonded or entangled with each other, and a nonwoven fabric. The web as the first fiber layer-forming material includes a carded web containing the heat shrinkable fibers.

The nonwoven fabric as the first fiber layer-forming material includes heat shrinkable fiber-containing fiber aggregates produced through various nonwoven fabric techniques, such as thermal bonding, hydro-entangling, needle punching, solvent bonding, spun-bonding, and melt-blowing.

The second fiber layer 2 (or the second fiber layer-forming material) comprises heat non-shrinkable fibers. The term "(heat) non-shrinkable fiber" as used herein is used to include not only fiber having no heat shrinkability but also fiber which has heat shrinkability but does not substantially shrink at or below the shrinkage starting temperature $T_S$ of the heat shrinkable fiber contained in the first fiber layer-forming material. The second fiber layer-forming material preferably contains a heat bondable fibers containing a heat fusible resin whose melting point $T_M$ is higher than the shrinkage starting temperature $T_S$ of the heat shrinkable fiber contained in the first fiber layer-forming material. A preferred content of the heat bondable fiber in the second fiber layer 2 is 70% by weight or more, particularly 80% by weight or more, in terms of the heat fusible resin of the heat bondable fiber. In the most preferred mode, the non-shrinkable fiber making up the second fiber layer 2 consists essentially of the heat bondable fibers. The melting point $T_M$ of the heat fusible resin is preferably higher than the shrinkage starting temperature $T_S$ of the shrinkable fiber of the first fiber layer-forming material by 5° C. or more, i.e., $T_M > T_S + 5°$ C. By this design, when or after the first fiber layer-forming material thermally shrinks to cause the second fiber layer-forming material to raise and form protrusions 4, the fibers constituting the protrusions 4 fuse to each other. As a result, protrusions 4 with increased shape retention are formed, and the resulting bulky sheet material 10 exhibits improved texture and cushioning properties. The melting point $T_M$ of the fusible resin can range from, e.g., 125 to 145° C. Thus, when the first fiber layer-forming material partly joined with the second fiber layer-forming material is shrunken, the heat bondable fiber contained in the second fiber layer-forming material is prevented from excessive melting so that the resulting bulky sheet material has a satisfactory texture. It is preferred for assuring a satisfactory texture of the bulky sheet material that the upper limit of the fusible resin's melting point $T_M$ be about $(T_S+50)°$ C. It is also preferred for further enhancing the bonding strength between the first fiber layer 1 and the second fiber layer 2 and for preventing deterioration in texture on shrinkage to use heat bondable fiber containing a fusible resin whose melting point $T_M$ is $(T_T-20)°$ C. or higher in a proportion of 70% by weight or higher, particularly 90% by weight or higher, in terms of the fusible resin, based on the weight of the second fiber layer 2. $T_T$ represents the temperature to carry out the shrinkage of the heat shrinkable fiber contained in the first fiber layer-forming material.

Where the first fiber layer-forming material contains a heat bondable fiber, it is preferred that the melting point of the fusible resin of the heat bondable fiber of the first fiber layer-forming material and that of the fusible resin of the heat bondable fiber of the second fiber layer-forming material be equal or have a difference of 10° C. or smaller. This makes it possible to fusion bond the first fiber layer-forming material and the second fiber layer-forming material at relatively low temperatures and to further enhance the bonding strength of the two layers. The heat bondable fibers contained in the first fiber layer-forming material and the second fiber layer-forming material may be the same or different kind.

The heat bondable fiber which can be used to form the second fiber layer 2 includes ethylene-propylene random copolymer fiber, polypropylene fiber, polyester (e.g., polyethylene terephthalate) fiber, and polyamide fiber. Core-sheath conjugate fiber or side-by-side conjugate fiber made of a combination of these thermoplastic polymers is also useful. The heat bondable fiber may be staple fiber (short fiber) or filaments (long fiber). A suitable fineness is about 1 to 7 dtex. In particular, short fiber of a conjugate fiber is preferred for the elastomeric behavior developed after shrinkage, which gives a satisfactory texture to the resulting bulky sheet material. The heat bondable fiber to be used in the first fiber layer 1 can be selected from the same fibers described above.

It is preferred that the fiber contained in the bulky sheet material 10 other than the heat shrinkable fiber, whichever fiber layer it may exist in, has a melting point higher than the shrinkage starting temperature $T_S$ of the heat shrinkable fiber. In this case, the bulky sheet material is suppressed from wrinkling and fuzzing and has an improved texture. Where the fiber other than the heat shrinkable fiber is a multi-component conjugate fiber, the lowest of the melting points of the constituent resins is taken as the "melting point" of the fiber.

The form of the second fiber layer-forming material which provides the second fiber layer 2 on shrinkage of the first fiber layer-forming material includes a web, which is a fiber aggregate having the constituent fibers in a state not bonded or entangled with each other, and an nonwoven fabric. A web is preferred because, when the first fiber layer-forming material shrinks, the web easily rises, changing its area or form, to form protrusions filled with fibers, thereby providing a sheet with cushioning properties and a soft texture. The web as a second fiber layer-forming material can be obtained by, for example, carding. The bulky sheet material 10 formed by using the web as a second fiber layer-forming material is bulky and has protrusions 4 filled with fibers which are oriented along the contour of the protrusions. A carded web, in particular, becomes a second fiber layer 2 having only sparse fiber to provide a bulky sheet material which is permeable to and retentive of a highly viscous liquid and highly deformable when compressed in the thickness direction. The highly viscous liquid includes soft stool, menstrual blood, cleaning agents or moisture-retaining agents for human bodies, and cleaning agents for inanimate objects.

The basis weight of the first fiber layer-forming material is, while varying with the use of the bulky sheet material 10, preferably 5 to 50 g/m$^2$, still preferably 15 to 30 g/m$^2$, for providing a bulky sheet material with sufficient bulkiness and improved compressive deformability, which leads to improved flexibility, and from economical consideration. The basis weight of the second fiber layer-forming material is, while varying with the use of the bulky sheet material 10, preferably 5 to 50 g/m$^2$, still preferably 15 to 30 g/m$^2$, for the same reasons as with the first fiber layer-forming material and, in addition, for securing sufficient breathability. The "basis weight" of the first and the second fiber layer-forming materials as referred to here is the one before the two layer-forming materials are joined.

Figure 3:
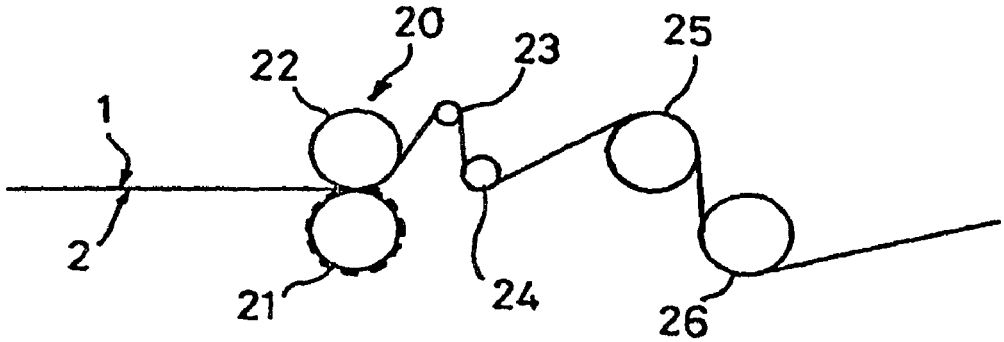
FIG. 3 is a schematic illustration of a preferred apparatus for producing a bulky sheet material of the present invention.

A preferred process for producing the bulky sheet material 10 according to the above-described embodiment will then be described. FIG. 3 shows a preferred apparatus which can be used to produce the bulky sheet material 10. First of all, a first fiber layer-forming material 1 and a second fiber layer-forming material 2 are prepared by prescribed methods. The two materials are superposed on each other and partly fusion bonded together by passing through a heat embossing machine 20 having an engraved roll 21 and a smooth roll 22 at a temperature not lower than the shrinkage starting temperature $T_S$ of the heat shrinkable fiber contained in the first fiber layer-forming material 1 while applying tension to the two materials. Unlike conventional methods, the process of the present invention permits setting a fusion bonding temperature irrespective of the shrinkage starting temperature $T_S$ of the heat shrinkable fiber contained in the first fiber-forming material 1. For example, the fusion bonding temperature can range 125 to 160° C. In this step, joints 3, which are fusion bonded parts, are formed whereby the two fiber layer-forming materials are joined in the thickness direction. The two fiber layer-forming materials 1 and 2 are preferably passed through the rolls with the first fiber layer-forming material 1 facing the smooth roll 22, and the second fiber layer-forming material 2 facing the engraved roll 21 for the following reasons. For one thing, in order to apply tension to the two fiber layer-forming materials, it is preferred to wrap them around the heat embossing machine 20 at a large wrap angle as described infra. In this case, fibers are liable to enter the depressions of the engraved roll 21 thereby to cause wrinkles. Therefore, it is preferred to wrap the first fiber layer side around the smooth roll 22 which is less causative of wrinkles than the engraved roll 21. For another, the fiber layer-forming materials are less susceptible to shrinkage to give a better texture when wrapped around a roll having a relatively lower temperature. From this viewpoint, too, it is preferred that the first fiber layer-forming material 1 which has a relatively lower melting point be in contact with the smooth roll 22, while the second fiber layer-forming material 2 be in contact with the engraved roll 21. The heating temperature of the engraved roll 21 of the embossing machine 20 preferably ranges 100 to 155° C., particularly 125 to 155° C., while depending on the kinds of the fibers. The heating temperature of the smooth roll 22 is preferably 100 to 150° C., still preferably 110 to 140° C.

The purpose of applying tension during fusion bonding is to inhibit thermal shrinkage of the heat shrinkable fiber contained in the first fiber layer-forming material. As is understood from this purpose, it suffices that tension is applied only to the first fiber layer-forming material. However, because it is difficult to apply tension only to the first fiber layer-forming material, tension is given to both the first and the second fiber layer-forming materials in the present embodiment. Applying tension to both the materials produces an incidental advantage that the materials are prevented from clinging to the rolls and receiving more heat than necessary for fusion bonding. The tension is preferably applied in the machine direction (MD) and/or the cross direction (CD) of the fiber layer-forming materials. For effectively preventing the heat shrinkable fiber of the first fiber layer-forming material from shrinking, it is still preferred to apply tension in both the MD and the CD.

As long as the heat shrinkable fiber is inhibited from shrinkage in the step of fusion bonding, (1) distinct protrusions and depressions are formed easily; (2) fuzzing is prevented; and (3) the first fiber layer-forming material shrinks sufficiently and uniformly with ease of control on shrinkage percentage in the subsequent shrinking step.

Figure 4:
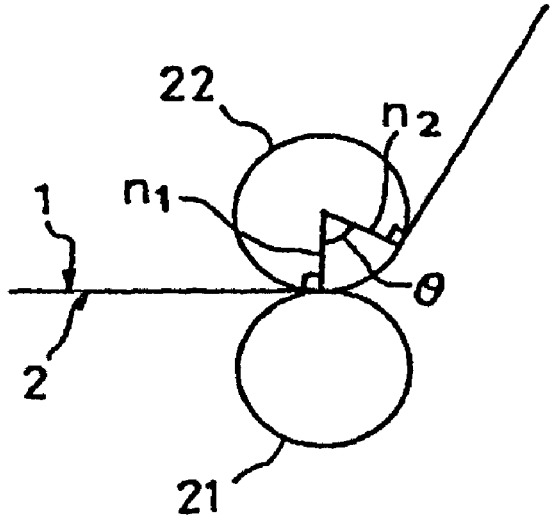
FIG. 4 schematically illustrates the measurement of a wrap angle.

Tension in the MD can be applied by, for example, providing tension rolls 23 and 24 in the downstream of the embossing machine 20, the tension rolls 23 and 24 rotating at higher speeds than the rolls of the embossing machine 20. In order to generate large tension, the joined fiber layer-forming materials are preferably wrapped around the tension rolls 23 and 24 so that they may run in an S-shape. Tension in the CD can be applied by wrapping the materials around the smooth roll 22 of the embossing machine 20 at a large wrap angle. The wrap angle around the smooth roll is preferably 30° or larger, still preferably 60 to 90°. As shown in FIG. 4, the wrap angle θ is defined to be an angle formed between the normal n1 to the point of first contact of the fiber layer-forming materials 1 and 2 with the smooth roll and the normal n2 to the point where the materials 1 and 2 separate from the smooth roll 22. The tension to be applied is such that the heat shrinkable fiber may not substantially shrink. Specifically, the MD tension is preferably about 4 to 20 cN/mm for suppressing shrinkage in the MD while controlling crosswise shrinkage, and the CD tension is preferably about 1 to 20 cN/mm for suppressing crosswise shrinkage.

It is preferred to provide the depressions of the engraved roll 21 with a heat insulating material. In this case, the heat shrinkable fiber hardly shrinks in the CD even under low tension, and repulsion against the materials' own force of shrinking is made use of for applying tension. Useful heat insulating materials include a nylon sheet, a bakelite sheet, an inorganic laminate having a glass fiber base (e.g., Miolex®), silicone rubber or sponge, and fluorine rubber or sponge. Preferred of them are those having high heat resistance and low thermal conductivity, for example, those having a thermal conductivity of not more than 2 W/mK, particularly 0.1 W/mK or less. Such a heat insulating material keeps its surface temperature lower than the projections by 10 to 20° C., thereby to effectively suppress shrinkage in the CD. The heat insulating material preferably has a thickness of about 1 to 3 mm for exerting the above-described performance.

Application of tension is continued after the two materials have passed through the embossing machine 20 until the temperature of the heat shrinkable fiber of the first fiber layer-forming material 1 drops below its shrinkage starting temperature $T_S$. In detail, the MD tension is continued being applied by keeping the rotational speed of the tension rolls 23 and 24 higher than that of the rolls of the embossing machine 20. The CD tension is continued being applied by wrapping the materials around the tension rolls 23 and 24 at large wrap angles to make the materials less prone to slide thereby making use of the materials' own repulsive force against shrinkage to create tension. The suppressive effect of the tension rolls 23 and 24 on shrinkage can be enhanced by making the surface of the tension rolls of such a material as to produce a large frictional force against the materials. The shrinkage-suppressive effect can further be enhanced by using a plurality of tension rolls as shown in FIG. 3. The shrinkage-suppressive effect can furthermore be enhanced by cooling the tension rolls 23 and 24 to accelerate cooling of the joined materials. Instead of cooling the tension rolls 23 and 24, it is also effective to provide cooling rolls 25 and 26, around which the materials are wrapped, in the downstream of the tension rolls 23 and 24 as shown in FIG. 3.

Once the temperature of the heat shrinkable fiber contained in the first fiber layer-forming material is reduced lower than its shrinkage starting temperature $T_S$, shrinkage no more occurs even with no tension applied. There is thus obtained a heat shrinkable heat-embossed nonwoven fabric consisting of a first fiber layer containing the heat shrinkable fibers in its shrinkable state and a second fiber layer comprising non-shrinkable fibers and provided on one side of the first fiber layer, the first fiber layer and the second fiber layer being partly bonded at a large number of joints (heat fusion bonded parts) formed by heat fusion bonding. While the heat shrinkable heat-embossed nonwoven fabric is an intermediate product for obtaining the bulky sheet material of the present invention, it is useful as such in various applications. For instance, the heat shrinkable heat-embossed nonwoven fabric can be used in place of elastic members such as rubber threads attached to side portions of sanitary napkins or leg opening portions of disposable diapers, which brings the following advantage. In producing an absorbent article having elastic members, a vacuum conveyer is required for conveying a product or an intermediate product in its extended state. Use of the heat shrinkable heat-embossed nonwoven fabric in place of the elastic members excludes the necessity of using such equipment. In using the heat shrinkable heat-embossed nonwoven fabric, it is fixed to a prescribed position of a sanitary napkin or a disposable diaper and then heat set to develop extensibility and contractibility to make gathers without using rubber threads and the like.

The joined first and second fiber layer-forming materials before being shrunken, i.e., the heat shrinkable heat-embossed nonwoven fabric (hereinafter sometimes simply referred to as the "shrinkable nonwoven fabric"), preferably has a tensile strength of 120 cN/5 cm or more, particularly 150 cN/5 cm or more. With this tensile strength, the nonwoven fabric can be conveyed smoothly before, during, and after shrinkage. Tensile strength is measured according to JIS L1913 at a pulling speed of 300 m/min. In detail, a specimen 50 mm wide in the CD and 250 mm long in the MD cut out of the nonwoven fabric is set between chucks (initial chuck distance: 200 mm) and pulled at a speed of 300 mm/min. The maximum load read before break is taken as a tensile strength. Measurement is made with a tensile/compression tester Tensilon RTA-100 supplied by Orientec.

The bulky sheet material 10 can be produced by heating the above-described heat shrinkable heat-embossed nonwoven fabric to shrink the heat shrinkable fiber contained in the first fiber layer-forming material 1. Heating is preferably carried out by blowing hot hair. Other heating means, such as microwaves, steam, infrared rays, and heat rolls, may also be used. The heat treating temperature $T_T$ for shrinkage is preferably in a range of from $T_S$ (the shrinkage starting temperature of the heat shrinkable fiber) to $(T_M+20)°$ C., wherein $T_M$ is the melting point of the fusible resin of the heat bondable fiber contained in the first fiber layer-forming material and/or the second fiber layer-forming material, particularly of from $(T_S+5)°$ C. to $(T_M+10)°$ C., which is preferred for obtaining a bulky sheet material with a good texture and excellent cushioning properties. The heat treatment can be carried out at a temperature $T_T$, e.g., of 125 to 150° C. for about 1 to 20 seconds.

In the shrinking step, the shrinkable nonwoven fabric is heated to or above the shrinkage starting temperature $T_S$ of the heat shrinkable fiber thereby to shrink the heat shrinkable fiber. Where the first fiber layer-forming material is a web, it is preferred to raise the treating temperature in a range of from $T_M$ of the fusible resin of the heat bondable fiber contained in the first fiber layer-forming material and/or the second fiber layer-forming material to $(T_M+10)°$ C. By this, fibers are fused together while keeping the texture of the second fiber layer 2, whereby a bulky sheet material which is prevented from fuzzing up and has excellent cushioning properties can be obtained. The heat shrinkable fiber contained in the first fiber layer-forming material may also undergo fusion bonding, which depends on the heating temperature and the kind of the fiber.

Where hot air is used to cause shrinkage, it is desirable to minimize frictional force applied to the nonwoven fabric. When the shrinkable nonwoven fabric is conveyed on a net, for example, it is advisable that hot air be blown from the back side of the net so as to make the pressure pressing the shrinkable nonwoven fabric zero or negative. It is also advisable to hold the shrinkable nonwoven fabric in a completely free state by use of a pin tenter or a clip tenter. Where a net is used to convey the shrinkable nonwoven fabric, the shrinkage percentages in the MD and CD can be controlled by adjusting the overfeed ratio of the shrinkable nonwoven fabric with respect to the net running speed and by adjusting the temperature and the air flow velocity. Where a tenter is used, the shrinkage percentages in the MD and CD can be controlled by setting the overfeed ratio and the width of the tenter as desired. The temperature and the hot air flow velocity are adjusted appropriately.

Where a pin tenter is used, for example, shrinkage can be controlled as follows. A pin tenter has a pair of chains running in the same direction of the moving nonwoven fabric. Each chain has many upstanding pins. The shrinkable nonwoven fabric passes through the pin tenter heated by hot air at a prescribed temperature (the heat treating temperatures in Tables given infra are measured temperatures of hot air) at a given speed. Entering the pin tenter, the shrinkable nonwoven fabric is fixed on the pins by a pinning roll. The pinning roll has an increased rotational speed by the MD shrinkage allowance so that the nonwoven fabric is caught by the pins in excess by the shrinkage allowance. For example, when a shrinkable nonwoven fabric having a length 100 is to be shrunken to a length 70, and the speed of the pinning roll is taken as 100, the speed of the pins is set at 70. In this case, the MD shrinkage percentage is defined to be 70%. On the other hand, shrinkage in the CD is controlled by gradually decreasing the distance between the pair of chains toward the running direction of the nonwoven fabric. For example, when a shrinkable nonwoven fabric having a width 100 is to be shrunken to a width 70, and the chain distance at the inlet of the pin tenter is taken as 100, the chain distance at the outlet is set at 70. In this example, the CD shrinkage percentage is defined to be 70%.

Upon shrinkage of the heat shrinkable fiber, the portions of the second fiber layer between the joints 3 rise to form protrusions 4. Since the constituent fibers in the protrusions 4 are firmly fusion bonded to each other, the protrusions 4 have high shape retention. The bulky sheet material as a whole exhibits a clear raised pattern. Where the second fiber layer-forming material is nonwoven fabric, since the fibers of the second fiber layer-forming material do not undergo re-melting, the resulting bulky sheet material has a satisfactory texture. Where the second fiber layer-forming material is a web, the bulky sheet material also has a good texture because the constituent fibers have been prevented from excessive melting that might have occurred at $(T_M+10)°$ C. or higher.

The bulky sheet material according to the present invention is suitable as, for example, a member of disposable articles which are disposed of after a single use or a few uses. It is also useful as a female member of a mechanical fastener or a base sheet of cataplasms. The bulky sheet material is specially suited as a member of disposable absorbent articles, such as sanitary napkins and disposable diapers, or disposable wipes for human bodies or inanimate objects. In applications to disposable absorbent articles, e.g., an absorbent article comprising a liquid permeable topsheet, a liquid impermeable backsheet, and an absorbent member interposed therebetween, the bulky sheet material is useful as a part of such a member as the topsheet, the backsheet or upstanding side cuffs.

The present invention is not limited to the above-described embodiment. For example, while the bulky sheet material 10 has the second fiber layer 2 on one side of the first fiber layer 1, the second fiber layer 2 may be provided on both sides of the first fiber layer 1, in which case the bulky sheet material has protrusions on both sides thereof.

The present invention will now be illustrated in greater detail with reference to Examples. The following Examples are presented as being exemplary of the present invention and should not be considered as limiting.

EXAMPLE 1

1) Preparation of First Fiber Layer-forming Material

Self-crimping fiber which was heat shrinkable core-sheath conjugate fiber consisting of polypropylene (PP) as a core and an ethylene-propylene copolymer (EP) as a sheath at a core/sheath weight ratio of 5/5 and having a fineness of 2.2 dtex, a fiber length of 51 mm, and a shrinkage starting temperature $T_S$ of 90° C. (CPP, available from Daiwabo Co., Ltd.) was carded with a roller carding machine to form a web having a basis weight of 12 g/m$^2$.

2) Preparation of Second Fiber Layer-forming Material

Heat bondable core-sheath conjugate fiber consisting of polyethylene terephthalate (PET) as a core and polyethylene (PE) as a sheath at a core/sheath weight ratio of 5/5 and having a fineness of 2.2 dtex and a fiber length of 51 mm (NBF-SH, available from Daiwabo Co., Ltd.) was carded with a roller carding machine to form a web having a basis weight of 13 g/m$^2$.

3) Preparation of Bulky Sheet Material

Figure 5:
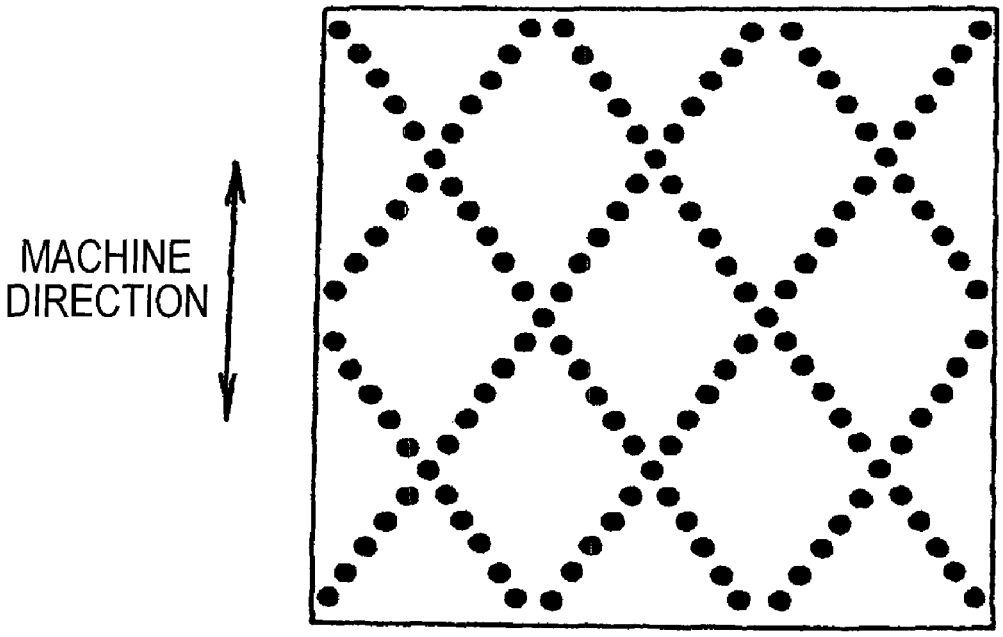
FIG. 5 shows an emboss pattern of an engraved roll.

The two webs prepared in (1) and (2) above were superposed on each other and joined by embossing through a heat embossing machine composed of an engraved roll and a smooth roll. The embossing was carried out by feeding the webs at a rate of 20 m/min under a roll linear pressure of 15 kgf/cm at a wrap angle of 0° with the first fiber layer-forming web in contact with the smooth roll, and the second fiber layer-forming web with the engraved roll. The smooth roll was set at 125° C., and the engraved roll at 155° C. The engraved roll had a heat insulating material made of silicone sponge (highly foamed silicone rubber sheet, standard item, available from Tiger Polymer; thickness: 1.5 mm) having a thermal conductivity of about 0.04 W/mK laid on the depressions thereof so as to apply tension in the CD. The emboss pattern of the engraved roll was as shown in FIG. 5. After the webs passed through the heat embossing machine, tension was continued being applied to the webs. A tension of about 20 cN/cm was applied in the MD by means of two tension rolls arranged in the downstream of the heat embossing machine. The rotational speed of the tension rolls was set higher than that of the rolls of the embossing machine. The tension was continued being applied until the temperature of the heat shrinkable fiber of the first fiber layer-forming web reduced lower than its shrinkage starting temperature. Thus, a heat shrinkable heat-embossed nonwoven fabric, a precursor of a bulky sheet material, was obtained.

The resulting shrinkable nonwoven fabric was thermally shrunken on a pin tenter to obtain a bulky sheet material under conditions of heat treating temperature $T_T$ of 134° C. (hot air temperature), MD and CD shrinkage percentages of 70%, total hot air amount of 5.3±1 m$^3$/min, hot air flow velocity of 7±1 m/sec, and time of passage in the tenter of about 14 seconds. The joint area ratio in the resulting bulky sheet material was 7%. The bulky sheet material had a great number of protrusions formed of the second fiber layer being raised between the joints by the shrinkage of the first fiber layer, with the joints forming depressions.

EXAMPLE 2

A bulky sheet material was prepared in the same manner as in Example 1, except that the set temperatures of the engraved roll and the smooth roll were changed as shown in Table 1 below. The resulting bulky sheet material had a great number of protrusions formed of the second fiber layer being raised between the joints by the shrinkage of the first fiber layer, with the joints forming depressions.

EXAMPLE 3

A bulky sheet material was prepared in the same manner as in Example 1, except that (i) the set temperatures of the engraved roll and the smooth roll were changed as shown in Table 1 and (ii) the engraved roll had no heat insulating material in the depressions but, instead, (iii) the two webs were wrapped around the smooth roll at a wrap angle of 60° to apply tension in the CD. The resulting bulky sheet material had a great number of protrusions formed of the second fiber layer being raised between the joints by the shrinkage of the first fiber layer, with the joints forming depressions.

EXAMPLE 4

A bulky sheet material was prepared in the same manner as in Example 1, except that (i) the heat shrinkable fiber shown in Table 1 was used to make the first fiber layer-forming web, (ii) the set temperatures of the engraved roll and the smooth roll were changed as shown in Table 1, and (iii) the engraved roll had no heat insulating material in the depressions but, instead, (iii) the two webs were wrapped around the smooth roll at a wrap angle of 60° to apply tension in the CD. The resulting bulky sheet material had a great number of protrusions formed of the second fiber layer being raised between the joints by the shrinkage of the first fiber layer, with the joints forming depressions.

EXAMPLE 5

A bulky sheet material was prepared in the same manner as in Example 1, except that (i) the basis weight of the first fiber layer-forming web was changed as shown in Table 1, (ii) core-sheath conjugate fiber consisting of PET as a core and EP as a sheath and having a fineness of 3 dtex (NBF-SP, available from Daiwabo) was used to make the second fiber layer-forming web, (iii) the basis weight of the second fiber layer-forming web was changed as shown in Table 1, (iv) the set temperatures of the engraved roll and the smooth roll were changed as shown in Table 1, and (v) the engraved roll had no heat insulating material in the depressions but, instead, (vi) the two webs were wrapped around the smooth roll at a wrap angle of 60° to apply tension in the CD. The resulting bulky sheet material had a great number of protrusions formed of the second fiber layer being raised between the joints by the shrinkage of the first fiber layer, with the joints forming depressions.

COMPARATIVE EXAMPLE 1

A mixture of 70 wt % of heat shrinkable core-sheath conjugate fiber consisting of PP as a core and an EP as a sheath at a core/sheath weight ratio of 5/5 and having a fineness of 2.2 dtex, a fiber length of 51 mm, and a shrinkage starting temperature $T_S$ of 90° C. (CPP, available from Daiwabo) and 30 wt % of low-temperature bondable fiber (EMA, available from Daiwabo; melting point: 90° C.) was carded with a roller carding machine to form a web having a basis weight of 12 g/m$^2$.

A sheet was prepared in the same manner as in Example 1, except that (i) the above-prepared web was used as a first fiber layer-forming material, (ii) the set temperatures of the engraved roll and the smooth roll were changed as shown in Table 2, (iii) the engraved roll had no heat insulating material in the depressions to apply no CD tension, and (iv) the heat treating temperature $T_T$ for shrinking was changed as shown in Table 2. The resulting sheet had joints formed by melting and solidification of the resin whose melting point was lower than the shrinkage starting temperature $T_S$ of the heat shrinkable fiber.

COMPARATIVE EXAMPLE 2

A sheet was prepared in the same manner as in Comparative Example 1, except for changing the set temperatures of the engraved roll and the smooth roll and the heat treating temperature $T_T$ as shown in Table 2. The resulting sheet had joints formed by melting and solidification of the resin whose melting point was lower than the shrinkage starting temperature $T_S$ of the heat shrinkable fiber.

COMPARATIVE EXAMPLE 3

A sheet was prepared in the same manner as in Comparative Example 1, except for changing the heat treating temperature $T_T$ as shown in Table 2. The resulting sheet had joints formed by melting and solidification of the resin whose melting point was lower than the shrinkage starting temperature $T_S$ of the heat shrinkable fiber.

COMPARATIVE EXAMPLE 4

A sheet was prepared in the same manner as in Example 1, except that (i) tension was not applied to the webs during and after heat embossing, (ii) the heat-embossed webs were shrunken by the heat inertia of the embossing machine, (iii) shrinking by means of a pin tenter was not carried out, and (iv) the set temperatures of the engraved roll and the smooth roll were changed as shown in Table 2. The heat shrinkable fiber did not shrink sufficiently, failing to develop bulkiness.

COMPARATIVE EXAMPLE 5

Polyethylene terephthalate/modified polyethylene terephthalate (PET/m-PET) (shrinkage starting temperature: 150° C.) was carded with a roller carding machine to prepare a web having a basis weight of 12 g/m$^2$. A sheet was prepared in the same manner as in Comparative Example 1, except for using the resulting web as a first fiber layer-forming material and changing the set temperatures of the engraved roll and the smooth roll and the heat treating temperature $T_T$ as shown in Table 2. Because the fibers of the second fiber layer-forming material almost melted, the resulting sheet had no fusion bonded parts (joints).

Performance Evaluation:

The sheets obtained in Examples and Comparative Examples were measured for basis weight, thickness T, and joint thickness T'. The sheets were evaluated for wrinkles, fuzz, and texture according to the following methods. Further, the tensile strength of the unshrunken nonwoven fabrics as obtained by heat embossing was measured according to the method previously described. The results of measurement and evaluation are shown in Tables 1 and 2.

a) Wrinkles

A 20 cm wide and 25 cm long piece was cut out of the sheet and observed. A cut piece having one or more linear projections of 0.5 mm or higher (wrinkles) in a non-joined portion (about 5 mm$^2$) thereof was judged "bad". A cut piece with no such wrinkles was judged "good".

b) Fuzz

Ten testers rubbed the surface of the sheet with their hand a few times and scored the appearance and the feel of the rubbed surface according to the following system. The average of the scores given by the testers was rated A to D as follows.

Scoring System:

−2: Considerable fuzzing and loss of fibers. Bad feel.

−1: Slight fuzzing and loss of fibers. Slightly bad feel.

+1: Faint fuzzing. Acceptable for practical use.

+2: No fuzzing nor loss of fibers. Good feel.

Rating System:

A: The scores average more than +0.5.

B: The scores average 0 to +0.5.

C: The scores average −0.5 to 0.

D: The scores average less than −0.5.

c) Texture

The ten testers touched the sheet with their hand and scored for softness and smoothness according to the following scoring system. The average of the scores was rated A to D as follows.

Scoring System:

−2: Stiff and rough.

−1: Slightly stiff and slightly rough.

0: Neither stiff nor soft. Neither rough nor smooth.

+1: Slightly soft and slightly smooth.

+2: Soft and smooth.

Rating System:

A: The scores average more than +0.5.

B: The scores average 0 to +0.5.

C: The scores average −0.5 to 0.

D: The scores average less than −0.5.

TABLE 1

| | | Example | | | | |
|---|---|---|---|---|---|---|
| | | 1 | 2 | 3 | 4 | 5 |
| 1st Fiber layer | Heat shrinkable fiber | PP/EP*[1] | PP/EP*[1] | PP/EP*[1] | PP/EP*[1] | PP/EP*[1] |
| | Melting point (° C.) | 145 | 145 | 145 | 138 | 145 |
| | Shrinkage starting temp. $T_S$ (° C.) | 90 | 90 | 90 | 80 | 90 |
| | Basis weight (g/m$^2$) | 12 | 12 | 12 | 12 | 19 |
| | Form before joining | web | web | web | web | web |
| 2nd Fiber layer | Heat bondable fiber | PET/PE*[2] | PET/PE*[2] | PET/PE*[2] | PET/PE*[2] | PET/EP*[2] |
| | Melting point $T_M$ (° C.) | 129 | 129 | 129 | 129 | 135 |
| | Basis weight (g/m$^2$) | 13 | 13 | 13 | 13 | 22 |
| | Form before Joining | web | web | web | web | web |
| Processing conditions | Engraved roll set temp. (° C.) | 155 | 140 | 145 | 125 | 125 |
| | Smooth roll set temp. (° C.) | 125 | 135 | 115 | 130 | 135 |
| | Roll linear pressure (kgf/cm) | 15 | 15 | 15 | 15 | 15 |

TABLE 1-continued

| | | Example | | | | |
|---|---|---|---|---|---|---|
| | | 1 | 2 | 3 | 4 | 5 |
| | Heat insulating material | provided | provided | not provided | not provided | not provided |
| | Tension (MD) | applied | applied | applied | applied | applied |
| | Wrap angle on smooth roll (°) | 0 | 0 | 60 | 60 | 60 |
| | Heat treating temp. $T_T$ (° C.) | 134 | 134 | 134 | 124 | 134 |
| Bulky sheet material | Basis weight (g/m$^2$) | 45.6 | 50.2 | 56.2 | 50.9 | 80.3 |
| | Thickness T (mm) | 2.24 | 2.7 | 2.71 | 2.46 | 3.82 |
| | Joint thickness T'(mm) | 0.05 | 0.05 | 0.05 | 0.05 | 0.05 |
| | Wrinkle | good | good | good | good | good |
| | Fuzz | B | B | B | B | B |
| | Texture | B | B | B | B | B |
| | Tensile strength after joining and before shrinking (cN/5 cm) | 619 | 258 | 194 | 201 | 184 |

Note:
*1core-sheath conjugate fiber;
*2core-sheath conjugate fiber

TABLE 2

| | | Comparative Example | | | | |
|---|---|---|---|---|---|---|
| | | 1 | 2 | 3 | 4 | 5 |
| 1st Fiber layer | Heat shrinkable fiber (wt %) | PP/EP*1 (70) | PP/EP*1 (70) | PP/EP*1 (70) | PP/EP*1 (100) | PET/modified-PET*1 (100) |
| | Melting point (° C.) | 145 | 145 | 145 | 145 | 237 |
| | Shrinkage starting temp. $T_S$ (° C.) | 90 | 90 | 90 | 90 | 150 |
| | Heat bondable fiber (wt %) | EMA*2 (30) | EMA*2 (30) | EMA*2 (30) | | |
| | Melting point (° C.) | 90 | 90 | 90 | | |
| | Basis weight (g/m$^2$) | 12 | 12 | 12 | 12 | 12 |
| | Form before joining | web | web | web | web | web |
| 2nd Fiber layer | Heat bondable fiber | PET/PE*3 | PET/PE*3 | PET/PE*3 | PET/PE*3 | PET/PE*3 |
| | Melting point $T_M$ (° C.) | 129 | 129 | 129 | 129 | 129 |
| | Basis weight (g/m$^2$) | 13 | 13 | 13 | 13 | 13 |
| | Form before joining | web | web | web | web | web |
| Processing conditions | Engraved roll set temp. (° C.) | 105 | 95 | 105 | 155 | 200 |
| | Smooth roll set temp. (° C.) | 105 | 95 | 105 | 125 | 200 |
| | Roll linear pressure (kgf/cm) | 15 | 15 | 15 | 15 | 15 |
| | Heat insulating material | not provided | not provided | not provided | not provided | not provided |
| | Tension (MD) | applied | applied | applied | not applied | applied |
| | Wrap angle on smooth roll (°) | 0 | 0 | 0 | 0 | 0 |
| | Heat treating temp. $T_T$ (° C.) | 135 | 120 | 110 | heat inertia | 170 |
| Bulky sheet material | Basis weight (g/m$^2$) | 50.6 | 37.2 | 37.2 | 38.2 | 48.2 |
| | Thickness T (mm) | 1.85 | 1.56 | 1.62 | 1.6 | 2.8 |
| | Joint thickness T' (mm) | 0.05 | 0.05 | 0.05 | 0.05 | 0.05 |
| | Wrinkle | bad | bad | bad | bad | bad |
| | Fuzz | B | C | D | D | B |
| | Texture | D (stiff) | C (stiff) | B | B | D |
| | Tensile strength after joining and before shrinkage (cN/5 cm) | 221 | 109 (difficult to carry) | 92 (difficult to carry) | 635 | un-measurable |

Note:
*1core-sheath conjugate fiber
*2low-temperature bondable fiber
*3core-sheath conjugate fiber As is apparent from the results in Table 1, the sheets of Examples according to the present invention proved less liable to fuzz up and satisfactory in texture. As is apparent from Table 2, in contrast, the sheet of Comparative Example 1 had wrinkles and a stiff texture. The sheet of Comparative Example 2 felt slightly better in texture than that of Comparative Example 1 but was still stiff, had wrinkles, and fuzzed up on rubbing. Further, the sheet of Comparative Example 2 had a low tensile strength before shrinkage and was difficult to carry. The sheet of Comparative Example 3 had a satisfactory texture but developed wrinkles and fuzz. Further, it had a low tensile strength before shrinkage and was difficult to carry. The sheet of Comparative Example 4 developed wrinkles and fuzz. It showed insufficient and uneven shrinkage. The sheet of Comparative Example 5 had wrinkles and was very stiff in texture. Further, the second fiber layer-forming material almost melted and adhered to the rolls, which resulted in extremely poor continuous productivity.

As described above, the bulky sheet material of the present invention exhibits high bulkiness, a satisfactory texture, and a satisfactory appearance. The protrusions of the bulky sheet material has high shape retention. The preferred process according to the present invention makes it possible to form protrusions and depressions in a desired configuration.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

This application claims the priority of Japanese Patent Application No. 2002-47353 filed Feb. 25, 2002, which is incorporated herein by reference.

What is claimed is:

1. A process of producing a bulky sheet material having three-dimensional protrusions comprising a first fiber layer and a second fiber layer provided on at least one side of said first fiber layer, said first fiber layer containing thermally shrunken heat-shrinkable fibers, said second fiber layer comprising heat non-shrinkable fibers, said first fiber layer and said second fiber layer being partly joined together at a large number of joints formed by fusion bonding, said joints being formed by melting and solidification of a heat fusible resin having a higher melting point than the shrinkage starting temperature of said heat shrinkable fiber, said second fiber layer forming a large number of protrusions between said joints by the heat shrinkage of the first fiber layer, and said joints forming depressions, wherein said process comprises the steps of:

partly fusion bonding a first fiber layer-forming material containing said heat shrinkable fibers and a second fiber layer-forming material comprising said heat non-shrinkable fibers provided on at least one side of said fiber layer-forming material with a heat embossing machine at or above the shrinkage starting temperature of said heat shrinkable fiber of said first fiber layer-forming material while applying tension to both said first fiber layer-forming material and said second fiber layer-forming material to form said joints, continuing applying said tension to both said first fiber layer-forming material and said second fiber layer-forming material which have passed through the heat embossing machine until the temperature of said heat shrinkable fibers contained in said first fiber layer-forming material reduces lower than the shrinkage starting temperature of said heat shrinkable fiber, releasing said tension and heating said first fiber layer-forming material and said second fiber layer-forming material at or above the shrinkage starting temperature of said heat shrinkable fiber to shrink said heat shrinkable fibers and to raise said second fiber layer-forming material between said joints thereby to form a large number of said protrusions.

2. The process according to claim 1, wherein said embossing machine comprises an engraved roll and a smooth roll, and said first fiber layer-forming material and said second fiber layer-forming material are wrapped around said smooth roll at a wrap angle of 30° or more to apply said tension.

3. The process according to claim 1., wherein said engraved roll has a heat insulating material provided on the depressions thereof.

4. The process according to claim 1, wherein at least one of said first fiber layer-forming material and said second fiber layer-forming material contains heat bondable fibers containing said heat fusible resin, and said heat shrinkable fibers are shrunken by heating at a temperature in a range of from the shrinkage starting temperature of said heat shrinkable fiber to a temperature higher than the melting point of said fusible resin by 20° C.

5. The process according to claim 1, wherein said embossing machine comprises an engraved roll and a smooth roll, and said first fiber layer-forming material and said second fiber layer-forming material are wrapped around said smooth roll at a wrap angle of 30° or more to apply said tension; and wherein said first and second fiber layer-forming materials are passed through the rolls with the first fiber layer-forming material facing the smooth roll and the second fiber layer-forming material facing the engraved roll.

* * * * *